US007963725B2

(12) United States Patent
Dawe

(10) Patent No.: US 7,963,725 B2
(45) Date of Patent: Jun. 21, 2011

(54) ROCK BOLT

(75) Inventor: Stephen George Dawe, Alberton (ZA)

(73) Assignee: Aveng (Africa) Ltd., Morningside (ZA)

( * ) Notice: Subject to any disclaimer, the term of this patent is extended or adjusted under 35 U.S.C. 154(b) by 296 days.

(21) Appl. No.: 10/577,548

(22) PCT Filed: Oct. 28, 2004

(86) PCT No.: PCT/ZA2004/000131

§ 371 (c)(1),
(2), (4) Date: Feb. 27, 2007

(87) PCT Pub. No.: WO2005/040557

PCT Pub. Date: May 6, 2005

(65) Prior Publication Data

US 2007/0217869 A1 Sep. 20, 2007

(30) Foreign Application Priority Data

Oct. 29, 2003 (ZA) ..... 2003/8405

(51) Int. Cl.
*E21D 20/00* (2006.01)
*E21D 21/00* (2006.01)

(52) U.S. Cl. ..... 405/259.1

(58) Field of Classification Search .... 405/259.1–259.6; 411/32, 19, 49–52, 72
See application file for complete search history.

(56) References Cited

U.S. PATENT DOCUMENTS

| | | | | |
|---|---|---|---|---|
| 3,469,407 | A * | 9/1969 | Kovacs | 411/61 |
| 4,312,604 | A | 1/1982 | Fu et al. | |
| 4,655,644 | A | 4/1987 | Lane et al. | |
| 4,664,561 | A * | 5/1987 | Frease | 405/259.6 |
| 4,954,017 | A * | 9/1990 | Davis et al. | 405/259.3 |
| 5,073,064 | A * | 12/1991 | Leonard et al. | 405/259.6 |

FOREIGN PATENT DOCUMENTS

| | | | |
|---|---|---|---|
| CH | 564 654 | A | 7/1975 |
| DE | 37 04 969 | A1 | 8/1988 |
| DE | 44 45 625 | A1 | 6/1996 |
| JP | 02210199 | A * | 8/1990 |

* cited by examiner

*Primary Examiner* — Sunil Singh
(74) *Attorney, Agent, or Firm* — Fitch, Even, Tabin & Flannery; Norman N. Kunitz

(57) ABSTRACT

A rock bolt (10) which includes An elongate tubular member (18), which is formed with an inlet (22) through which a pressurized fluid can pass, into an interior of the tubular member (18), thereby to expand the tubular member (18) in a radial direction, an elongate shank (12) with a first end (14) which is secured to the tubular member (18) and a second end (16), and an expansion unit (26) which has a wedge-shaped member (44) at the second end (16) of the shank (12).

10 Claims, 5 Drawing Sheets

ROCK BOLT

CROSS REFERENCE TO RELATED APPLICATION

This application is the National Stage filing under 35 U.S.C. 371 of International Application No. PCT/ZA2004/000131, filed Oct. 28, 2004, and claims priority of South African Patent Application No. 2003/8405 filed Oct. 29, 2003, the subject matter of which in its entirety, is incorporated herein by reference

BACKGROUND OF THE INVENTION

This invention relates to a rock bolt.

A friction-type rock bolt relies on friction which is generated between at least part of the bolt and a surrounding surface of a hole in which the rock bolt is located, to be effective. The effectiveness of the anchor, provided by the rock bolt, depends on the frictional force which is generated by the interaction of the bolt with the surrounding rock mass and on the length of the rock bolt which extends into solid rock, beyond the rock which is being supported by the rock bolt.

A mechanically-anchored bolt makes use of an expansion unit, at one end of a shank, which is expanded into close contact with a surrounding wall of a hole in which the rock bolt is inserted. A washer is connected to an opposing end of the shank, with the washer bearing on an outer surface of a rock face in which the hole is formed. The effectiveness of this type of anchor is dependent, at least, on the washer being in load-bearing contact with the rock face.

Although friction-type bolts are relatively easy to install they are susceptible to corrosion and, as noted, the effectiveness of this type of bolt depends on the frictional force which is generated.

SUMMARY OF INVENTION

The invention provides a rock bolt which includes an expansible tubular section and an expansion unit which is connected to the tubular section.

The tubular section may comprise an elongate tubular section which is radially expansible.

A valve may be connected to the tubular section and a pressurised fluid, eg. water, may be caused to pass through the valve into an interior of the tubular section to expand the tubular section.

The tubular section may be provided in a collapsed or non-expanded form wherein, in cross section, the tubular section includes a generally U-shaped outer portion and a smaller, generally U-shaped inner portion which is positioned at least partly inside the outer portion.

The valve may be connected to a first end of the tubular section.

A bearing plate or similar load-distributing appliance may be engaged with the tubular section preferably at a position at which the bearing plate abuts valve collar structure which serves to retain the bearing plate engaged with the tubular section.

The tubular section may have a second end which is tapered.

The rock bolt may include a stud or shank which extends between the tubular section and the expansion unit.

The tapered second end may be attached or secured to the stud in any appropriate way. For example the tubular section may be swaged onto the stud or it may be welded to the stud or both techniques of attachment may be used.

The expansion unit may be of any suitable kind and preferably comprises a spring-loaded bail-type expansion unit which has a conical or wedge-shaped member at one end of the shank, a plurality of shells which abut an outer surface of the wedge member, a bail which is connected to the shells and a biasing member, such as a coil spring, which acts between the bail and the wedge member.

The wedge-shaped member may be formed integrally with the shank, or it may be formed separately from the shank and then connected to the shank.

BRIEF DESCRIPTION OF THE DRAWINGS

The invention is further described by way of example with reference to the accompanying drawings in which.

DESCRIPTION OF PREFERRED EMBODIMENT

Figure 1:
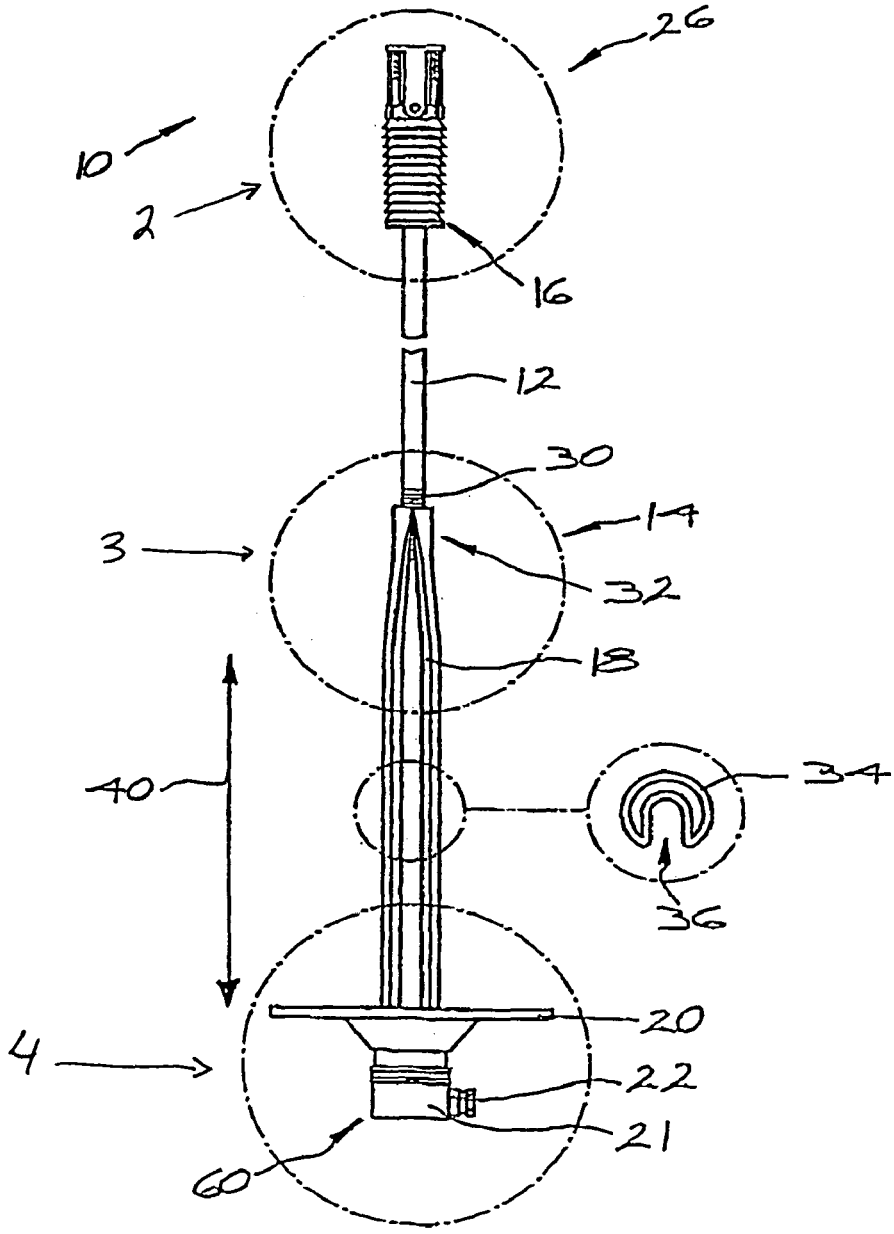
FIG. 1 is a side view of a rock bolt according to the invention.

FIG. 1 of the accompanying drawings illustrates a rock bolt 10 according to the invention which includes a stud or shank 12 with a first end 14 and a second end 16.

An elongate tubular collar 18 is attached to the end 14. A bearing plate or load-distributing washer 20 abuts a valve collar 21 to which is secured a valve 22. The valve collar 21 is fixed to a free end of the tubular collar by welding.

An expansion unit 26 is attached to the second end 16 of the stud.

The shank 12 is of substantially conventional construction and has a diameter and length which are determined by the application. The first end 14 is formed with formations 30 which may be thread formations or similar peaks and troughs which provide a surface to which an end 32 of the collar can be directly swaged. This is done by deforming the end 32 so that it at least partly encloses the formations 30. Thereafter the end is welded to the shank.

Figure 4:
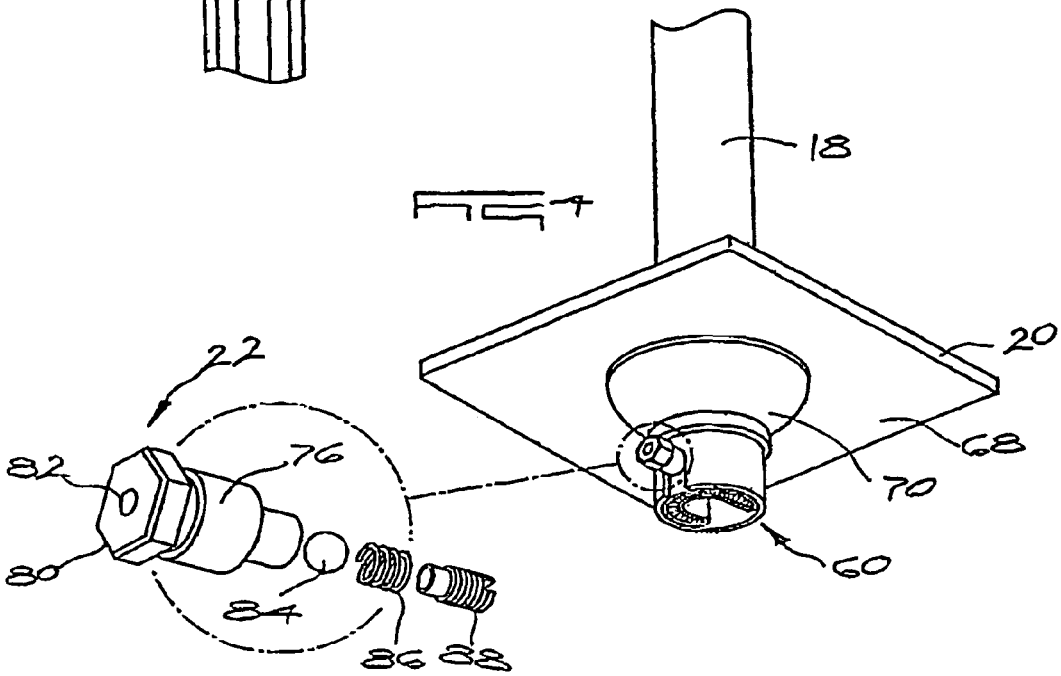
FIG. 4 is a perspective view from below of an end of the rock bolt marked "4" in FIG. 1 in an assembled state.

The collar is tubular, as is evident from an inset drawing in FIG. 1. The inset drawing and FIG. 4 show the construction of the collar in cross section. The collar has generally U-shaped outer portion 34 and a generally U-shaped inner portion 36, which is smaller than the outer portion, located inside the outer portion. Over a substantial portion 40 of its length, see FIG. 1, the tubular collar 18 has a constant cross section. The collar is tapered towards the end 32 so that it can be secured to the first end 14 of the stud by means of a swaging or similar process. In addition the collar is welded to the stud to ensure that these components are securely fixed to one another. At the same time the end 32 is sealed by welding.

Figure 2:
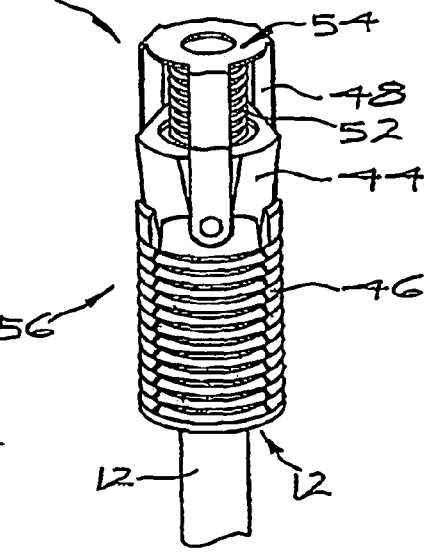
FIG. 2 is a perspective view on an enlarged scale of a portion of the rock bolt marked "2" in FIG. 1.
Figure 3:
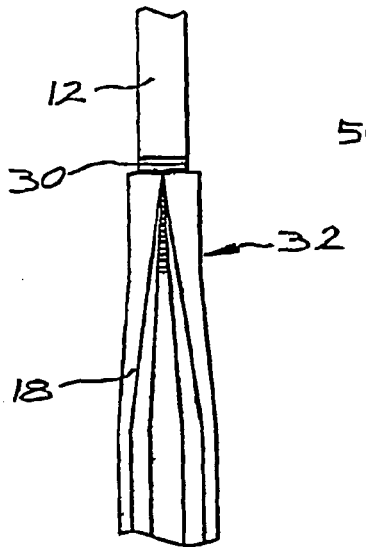
FIG. 3 is a side view on an enlarged scale of a portion of the rock bolt marked "3" in FIG. 1.

The second end 16 of the stud 12 is threaded and is engaged in a threaded hole, not visible in FIG. 2, which extends axially through a wedge- or conical-member 44 of the expansion unit 26. Three serrated shells 46 are positioned in tubular fashion around the wedge member and are connected to respective arms 48 of a bail 50. A coil spring 52 is positioned in an enclosure formed by the arms and extends between a base 54 of the bail and an opposing surface of the wedge member.

Lower ends 56 of the shells can be held together by means of a breakable tie, eg. of plastic or rubber, to ensure that the shells are retained in position during transport and storage.

The tubular collar 18 has a lower or second end 60 to which is attached the valve collar 21.

The valve collar 21 is tubular in cross-section and has an inner diameter 62 which is just large enough to pass over the tubular collar 18, and a flared end 64 to prevent the bearing plate 20 from travelling past the valve collar. There is a hole 66 in the U-shaped outer portion 34 of the collar 18 to accept the valve 22.

The bearing plate 20 is made from a planar metal sheet 68 with a dome 70 which has a centrally positioned hole 72 into which the tubular collar 18 is inserted.

The valve 22 includes a valve body 76 with a hexagonal head 80. A passage, not visible in FIG. 4, is formed through the body and one end terminates in a hole 82 in the head. A ball 84 and a spring 86 are positioned in the passage and a retaining screw 88, which is engageable with a complementary threaded formation inside the passage, acts on the spring to bias the ball to seal the hole. The valve is therefore of a substantially conventional nature in that it acts as a one-way filling valve. The valve body 76 is positioned over the hole 66 whereafter the valve body is welded to the outer surface of the outer portion. In this way the passage inside the body is placed in communication with the interior of the tubular collar.

Figure 5:
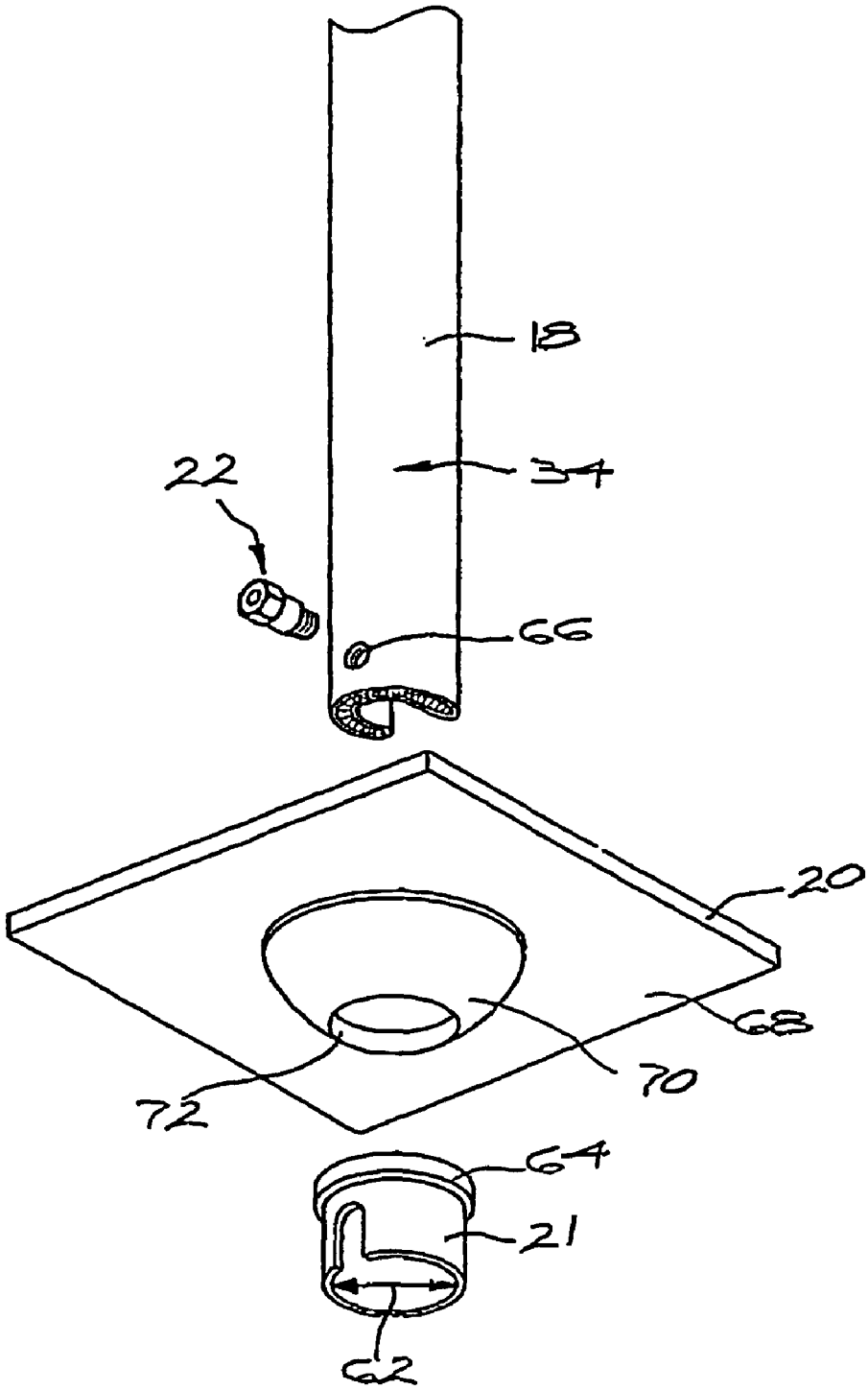
FIG. 5 is a view similar to FIG. 4 but illustrating the same components in an exploded configuration.

The lower end 60 of the tubular collar is shown in FIGS. 4 and 5. When the valve collar 21 is welded to the tubular collar, the end 60 is sealed by means of the welding. As both ends of the tubular collar (ie. the ends 32 and 60) are sealed by welding, the interior of the tubular collar is a sealed enclosure and access to the enclosure is only possible through the valve body.

Figure 6:
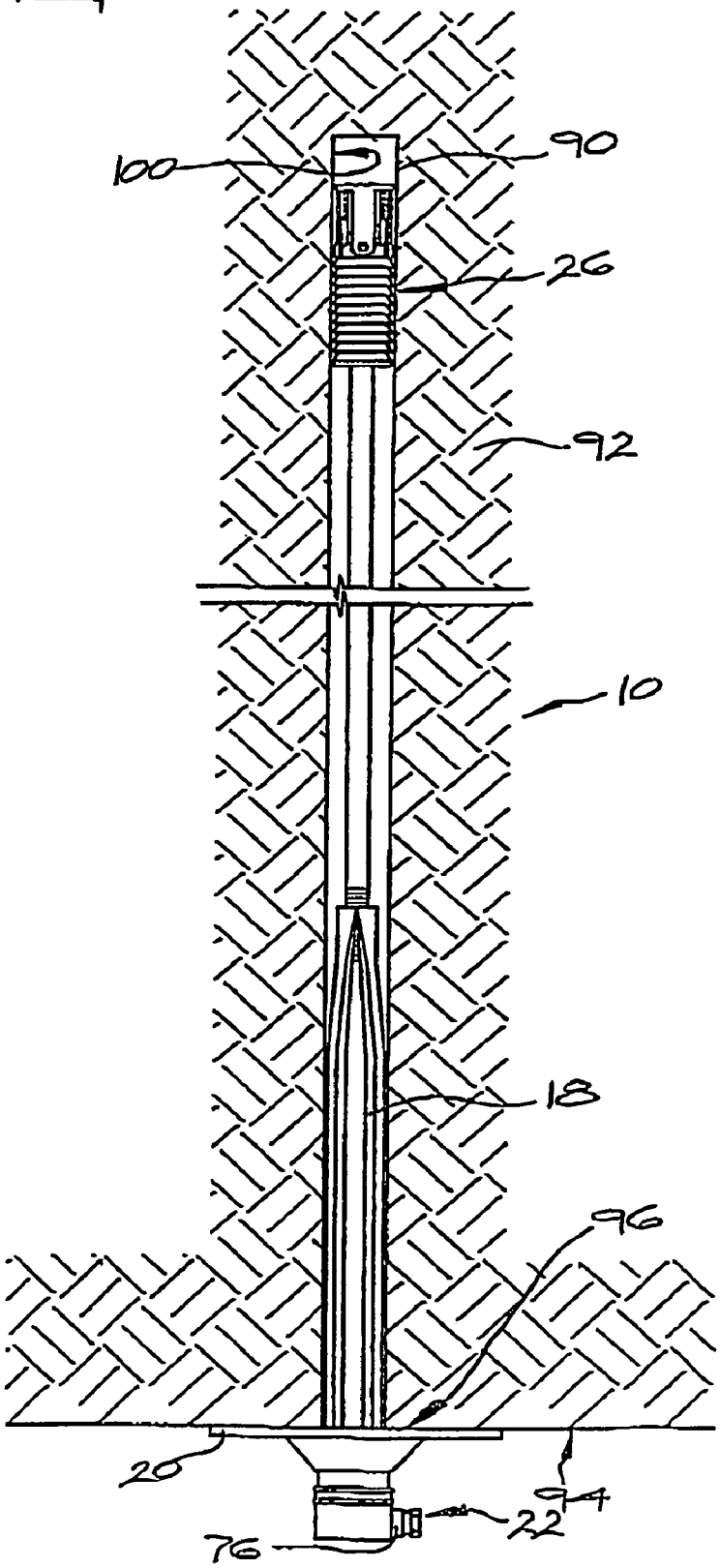
FIG. 6 illustrates from a side and in cross section the rock bolt of the invention installed in a rock face.

FIG. 6 illustrates the rock bolt 10 installed in a hole 90 which is drilled into a rock body 92 from a rock face 94. The rock bolt is pushed into the hole so that an inner surface 96 of the bearing plate 20 bears on the rock face 94.

The expansion unit 26 is actuated simply by twisting and pulling slightly on the end of the rock bolt which protrudes from the hole 90. This causes the unit to expand into load-bearing contact with the wall of the hole 90. Thereafter a pressurised source of water is connected to the valve 22. The valve body 76 is of a conventional design so that it can be used with existing water pumps and connectors.

When the interior of the tubular collar 18 is pressurised it expands radially into contact with an opposing surface 100 of the hole 90. At the time of installation therefore the rock bolt is anchored mechanically by means of the expansion unit 26 and frictionally by means of the inflated tubular collar. The mechanical anchor 26 is clearly not dependent on frictional effects, as is the case with conventional friction-anchored bolts, to exhibit its load-bearing characteristics. On the other hand the inflated tubular collar 18 bonds frictionally to the rock surface 100 adjacent the mouth of the hole and thereby reduces reliance on the load-bearing washer 20. The rock bolt is totally mechanical in operation and does not require grout or resin.

Figure 7:
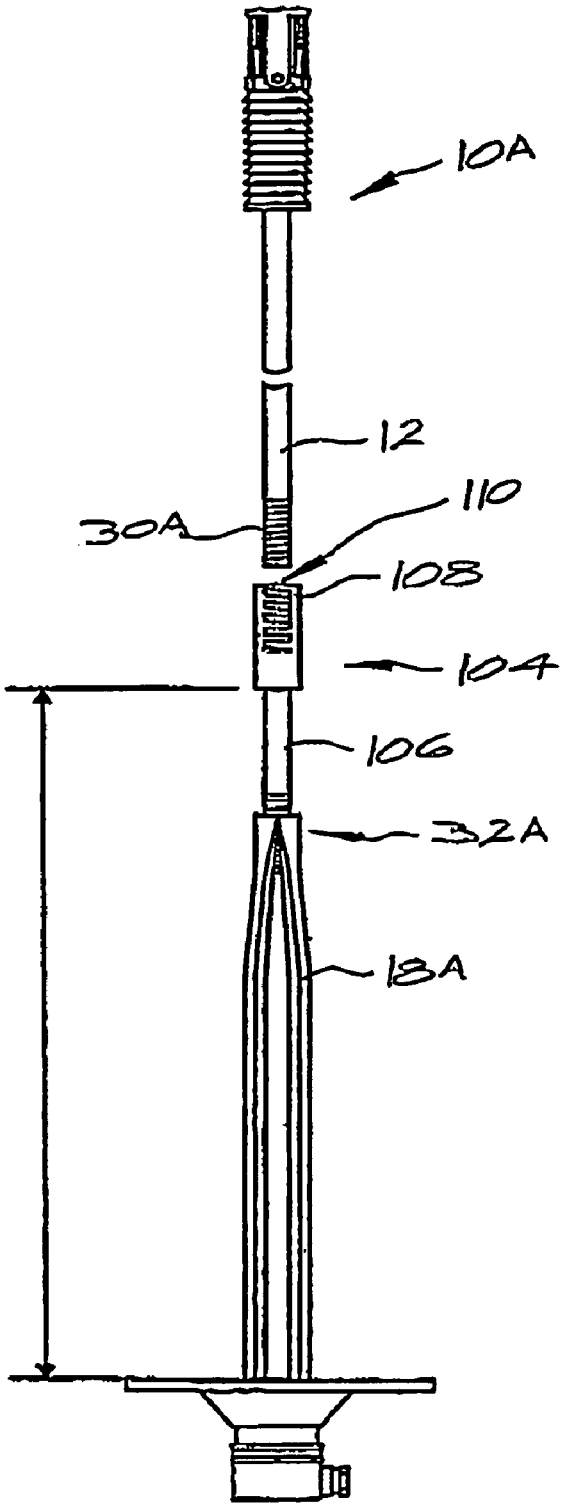
FIG. 7 illustrate a modified form of the rock bolt.

FIG. 7 illustrates a modified rock bolt 10A which includes an elongate tubular collar 18A which, except for aspects described hereinafter, is the same as the collar 18, and a shank 12A which is materially the same as the shank 12.

The rock bolt 10A includes a coupling device 104 which includes a short bar 106 and an internally threaded tube 108 which is attached to the bar 106 by being threadedly engaged therewith, or by means of a welding, swaging or any other technique which leaves the tube with an open mouth 110.

An end 32A of the collar 18A is attached to one end of the bar 106 in a manner which is similar to the way in which the shank 12 is attached to the collar 18 of the rock bolt 10.

An end 30A of the shank 12A is threaded and can be threadedly engaged with the tube 108 passing through the mouth 110.

The rock bolt 10A thus comprises two parts 12A and 18A respectively which are detachably engageable with each other in an indirect sense in that use is made of the coupling device 104 for this purpose. This approach allows the collar 18A to be standardised so that it is only necessary to select a shank 12A of an appropriate length, for use with the collar, according to the overall length of the rock bolt 10A which may be required for a particular installation. Also, as the shank and collar can be threadedly engaged with each other when the threaded end 30A and the tube 108 are positioned inside a hole, it becomes possible to install a rock bolt of an extended length in an underground location such as a stope which has limited clearance which normally would restrict the maximum length of a rock bolt which could be installed.

In a further modification, not shown in the drawings, the threaded end 30 is directly threadedly engaged with an internally threaded formation at the end 32 of the collar which, therefore, is not swaged to the shank 12 nor to the bar 106.

Most of the components used in the rock bolt of the invention are standard components and can be manufactured using existing technology. It is possible to incorporate a pop-out pressure indicator in the valve or on the tubular collar which allows for post-installation quality checks.

Depending primarily on the cross-sectional design of the tubular collar 18 the valve 22 can comprise a one-way filler valve so that the interior of the collar 18, once the collar has been expanded, remains pressurised. Alternatively water can be allowed to drain from the tubular collar which then remains frictionally engaged with the wall of the hole due to its previous expansion.

The invention claimed is:

1. A rock bolt which in use is inserted in a drill hole extending from a rock face into a rock body and which includes: a radially expandable elongate tubular member with a closed end and an opposed end in which is formed an inlet through which a pressurized fluid can pass into an interior of the tubular member, thereby to expand the tubular member in a radial direction and so effect a first frictional anchoring action of the tubular member with a wall of the drill hole at a first location near a mouth of the drill hole; a mechanical expansion anchor unit that is operable to effect a second anchoring action with the wall of the drill hole at a second location that is displaced from the first location; a bearing plate mounted on said opposed end of said tubular member for engaging the rock face when the rock bolt is inserted in a drill hole; and a further elongate member having a first end secured to the closed end of the tubular member and a second end that is threadedly connected to the mechanical expansion anchor unit, and which is rotatable relative to the mechanical expansion unit for operating the mechanical expansion unit to effect the second anchoring action independently of the operation of the first anchoring action.

2. A rock bolt according to claim 1 wherein the tubular member, in a non-expanded form, includes a generally U-shaped outer portion and a smaller, generally U-shaped inner portion which is positioned at least partly inside the outer portion.

3. A rock bolt according to claim 1 which includes a valve collar that is attached to the opposed end of the tubular member and the bearing plate is engaged with the tubular member at a position at which the bearing plate abuts the valve collar which serves to retain the bearing plate engaged with the opposed end of the tubular member and the rock face when the rock bolt is inserted in a drill hole.

4. A rock bolt according to claim 1 wherein the first end of the further elongate member is directly secured to the tubular member.

5. A rock bolt according to claim 1 which includes a coupling device which is secured to the tubular member and the further elongate member is indirectly secured to the tubular member by being detachably threadedly engaged with the coupling device.

6. A rock bolt according to claim 1 wherein the further elongate member is a shank or stud.

7. A rock bolt according to claim 6 wherein the tubular member is swaged or welded onto the shank, or is threadedly engaged with the shank.

8. A rock bolt according to claim 6 wherein the closed end of the tubular member at least partly encloses the first end of the shank.

9. A rock bolt according to claim 1 wherein the expansion anchor unit includes a wedge member, and a plurality of shells which are radially movable by the wedge member to effect the second anchoring action.

10. A rock bolt according to claim 9 wherein the wedge member is connected to the second end of the further elongate member, and the plurality of shells abut an outer surface of the wedge member, and the mechanical expansion anchor unit further includes a bail which is connected to the shells and a biasing member which acts between the bail and the wedge member.

* * * * *